US006296902B1

(12) United States Patent
Parra Soriano

(10) Patent No.: US 6,296,902 B1
(45) Date of Patent: Oct. 2, 2001

(54) SEALING PROCESS FOR SURFACE PORES OF CONSTRUCTION PARTS

(75) Inventor: Manuel José Parra Soriano, Villarreal (ES)

(73) Assignee: Venis, S.A., Madrid (ES)

( * ) Notice: Subject to any disclaimer, the term of this patent is extended or adjusted under 35 U.S.C. 154(b) by 0 days.

(21) Appl. No.: 09/537,124

(22) Filed: Mar. 29, 2000

(30) Foreign Application Priority Data

May 21, 1999 (ES) ..... 9901123

(51) Int. Cl.[7] ..... B05D 1/02

(52) U.S. Cl. ..... 427/180; 427/195; 427/198; 427/348; 427/368; 427/421

(58) Field of Search ..... 427/180, 195, 427/299, 348, 358, 486, 475, 189, 421, 198, 350, 355, 368; 52/177

(56) References Cited

U.S. PATENT DOCUMENTS 4,810,533 * 3/1989 Smith .
5,516,551 * 5/1996 Anderson et al. .

OTHER PUBLICATIONS

"Powder Coating: The Complete Finisher's Handbook", Ed by Nicholas P. Liberto, pp.1–2, 1994.*

* cited by examiner

*Primary Examiner*—Fred J. Parker
(74) *Attorney, Agent, or Firm*—Ostrolenk, Faber, Gerb & Soffen, LLP

(57) ABSTRACT

Sealing process for surface pores of construction parts, particularly parts in the form of cover plates and/or face plates, both prefabricated and made form natural rock, comprising: application of a curable resin powder on the surface of the parts to be treated, introducing the excess resin powder into the pores to be sealed; and proceeding to cure the resin powder contained inside the pores.

9 Claims, No Drawings

SEALING PROCESS FOR SURFACE PORES OF CONSTRUCTION PARTS

BACKGROUND OF THE INVENTION

The present invention relates to a sealing process for surface pores of construction parts, particularly parts in the form of cover plates and/or face plates, both prefabricated and made from natural rock.

This invention to applicable in sealing surface pores of tiles, stoneware and porcelain both enamelled and not. Likewise, it is applicable to granites, rock, marble, earth ware, hydraulics, earth, cotto and in general to all materials used in construction, those used for floors or tiles susceptible of having surface pores and therefore susceptible of being stained or attacked by certain acids.

Construction materials which have surface pores, either due to their intrinsic nature or to polishing processes suffer from corrosion more than others due to the possible penetration of certain acids or aggressive agents through their pores. Likewise, in these surface pores may enter dyes and other staining substances which are hard to remove.

In order to avoid these problems the surface pores may be sealed or covered. Presently, two industrial processes are known for sealing surface pores in construction parts.

One of these processes is based on using waxes which are introduced in the pores to thus seal or cover them. The main drawback of waxes is that they tend to get dirty themselves due to their own nature and by contact with the surroundings, as they are easily contaminated by contact with any external element. Their subsequent cleaning is virtually impossible. A further problem presented by this system is that waxes are not resistant to solvents, and thus with the use of solvents in detergents they are gradually removed from the pores and over time are completely eliminated after successive cleaning, so that the pore is again uncovered.

The second known process used industrially to date is application of silicone sprays or hydrophobic liquids, that is, liquids whose principal characteristic is that they repel an aqueous base. The main problems presented by use of the liquid is that cleaning of the excess in the product manufacture stage is more difficult. Additionally, they are not very resistant to solvents so that we find the same problem mentioned above in sealing pores permanently. Sealing processes based on non-polymerisable liquids also suffer from their removal by solvents, leaving the pore exposed once again.

SUMMARY OF THE INVENTION

The object of the present invention is to solve the aforementioned problems by a sealing process for surface pores of simple application, indefinite duration and which maintains its properties over time, so that it does not show problems of dirtying or fading.

The process of the invention consists of applying resin powder which may be cured on the surface of the parts to be treated. The powder is incrusted in the surface pores mechanically and the resin is then cured, obtaining a permanent seal for the pores since the resin is cured inside the pore itself.

The process of the invention is applicable to sealing open surface pores created during the polishing process or due to the intrinsic nature of the product surface.

Sealing with resins according to the invention eliminates the risk of stain formation and reduces or eliminates the risk of attack by certain acids.

The invention is applicable to any industrial process which intends to seal pores produced after polishing or due to the intrinsic nature of the materials employed, particularly of interest in the industry of ceramic tiles and floor tiles in all their forms, including the industry of granite, marble, earth ware, etc.

The process of the invention may use curable resins of three different types:

a) Heat curing. Those cured by heat.

b) Resins with photoinitiators. Those cured by light.

c) Heat curing and with photoinitiators, i.e. they begin the curing process with light and end it with heat.

The technical properties of the resins specifically used in the process of the invention are the following:

a) Chemical nature:

1) Epoxy: good adherence (particularly on metals) but not too stable to light, so that they are used mainly for construction materials meant to be used indoors.

2) Polyester: good photostability, so that they may be used for materials which are to be used outdoors.

3) Epoxy-polyester hybrids: seek the positive properties of both.

4) Polyurethane hybrids: their main properties are good adherence to most materials, good resistance to solvents and stability with light, which makes these resins suitable for the purpose of this invention.

b) Particle size:

The size of the particles used in this process and their granulometric intervals will depend on the average size of the pores to be covered, as the size of these pores can vary considerably for the different surfaces to be treated.

c) Colour of the powder:

The process may use colourless or coloured powder indifferently, depending on the requirements of the material whose open surface pores are to be covered.

DETAILED DESCRIPTION OF EMBODIMENTS OF THE INVENTION

With the purpose of further explaining the properties and advantages of the invention a more detailed description of the same is given, with reference to the various stages of which it consists.

As initially explained, the basic concept of the invention lies in introducing resin powder into an open surface pore and its subsequent curing.

This process may be carried out in the following stages: a) cleaning and drying of the parts to be treated; b) application of the resin powder to the interior of the surface pores; c) cleaning of excess resin and d) curing process with the resin already inserted in the pore.

a) Cleaning and drying of the parts to be treated. It is vital to remember that precision in a suitable cleaning of the parts to be treated with the resin powder determines to a great extent the successful sealing of the pores, so that the resin adheres to the part properly. The cleaning process may employ chemical, physical, aqueous or solvent based or soap based processes, optionally including brushing an/or rinsing steps. Finally, the part is dried.

b) Application of the resin powder to the interior of the surface pores, for which the selected resin powder is applied to the surface of the parts to be treated. The system used to apply and distribute the resin as evenly as possible may consist of spraying the resin powder on the surface of the part. After this the resin powder must be inserted in the pores to be sealed. This may be managed for example by a combination of friction and pressure, applying the pressure required to insert the powder in the pores, all of which will depend on the material to be treated.

c) Cleaning excess resin. Once the resin powder has been inserted in the pores the surface of the part must be cleaned and the excess powder eliminated. This can be achieved by the combined action of pressurized air, friction by a non-abrasive roller and given the electrostatic properties of the materials used, action of a deioniser, which provides effective elimination and cleansing of the excess resin powder. This cleaning process allows the surface of the pores to be free of excess resin before the following stage of the process.

d) Curing process with the resin already in the pores. Once the resin is inside the pores and with the part surface clean, after elimination of excess resin, the part is subjected to a curing process for the resin employed. This process consists of a cycle of two factors, time and temperature, which are closely related to each other.

The heat curing cycle will be selected by combining the temperature and duration of the process. The higher the temperature, the shorter the required curing time.

The curing process of the resin need not involve temperature. The resin may instead be cured by applying ultraviolet radiation to the porous parts with the incorporated resin for a time which will depend on the properties of the resin employed. The same process may be used for resins with both photoinitiators and heat curing. More specifically, heat is added to the ultraviolet rays to obtain final curing, or ultraviolet radiation is utilized to obtain final curing of a resin whose curing has been initiated by heat.

As can be understood, other curing methods for resin powder may be used depending on the nature of the resin employed and the porous surface to which they are applied.

What is claimed is:

1. A sealing process for surface pores of construction parts having a surface which contains pores, comprising the steps of: a) application of a curable resin powder to the surface of the parts to be treated; b) inserting the resin powder in the pores of the parts; c) eliminating from the surface of the part any excess resin powder to form a clean surface while maintaining the resin powder in the pores and d) curing the resin powder inside the pores of the part.

2. The process of in claim 1, wherein the resin powder has a smaller particle size than the diameter of the pores to be treated.

3. The process of in claim 1, further comprising the step, before applying the resin powder, of subjecting the surface of the parts to be treated to a cleaning and preparation process which includes the steps of applying detergents to the surface, brushing the surface, and rinsing and drying the surface.

4. The process of in claim 1, wherein application of the resin powder on the surface of the parts is by spraying the powder on said surface.

5. The process of in claim 1, wherein the resin powder is introduced in the pores of the parts by applying friction to the surface of said parts after application of the resin powder to the surface.

6. The process of in claim 1, wherein the resin powder is introduced in the pores of the parts by applying friction and pressure to the surface of said parts after application of the resin powder to the surface.

7. The process of in claim 1, wherein the excess resin powder is eliminated from said surface by blowing.

8. The process of in claim 1, wherein the excess resin powder is eliminated from said surface by brushing.

9. The process of in claim 1, wherein the excess resin powder is eliminated from said surface by a de-ioniser.

* * * * *